United States Patent [19]

Begley

[11] Patent Number: 4,813,562

[45] Date of Patent: Mar. 21, 1989

[54] REVERSED-ARC BAND FOR TAMPER-EVIDENT CAP

[75] Inventor: Douglas G. Begley, Palatine, Ill.

[73] Assignee: Continental White Cap, Inc., Northbrook, Ill.

[21] Appl. No.: 190,090

[22] Filed: May 4, 1988

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 2,812,093 | 11/1957 | Podesta . | |
| 3,314,564 | 4/1967 | Anderson et al. . | |
| 3,329,295 | 7/1967 | Fields | 215/252 |
| 3,455,478 | 7/1969 | Fields et al. | 215/252 |
| 3,460,703 | 8/1969 | Leftault | 215/252 |
| 4,147,268 | 4/1979 | Patel et al. | 215/252 |
| 4,197,960 | 4/1980 | Walter | 215/252 X |
| 4,524,876 | 1/1985 | Kusz | 215/253 X |
| 4,565,293 | 1/1986 | Jones | 215/252 X |
| 4,572,388 | 2/1986 | Luker et al. | 215/252 |
| 4,635,808 | 1/1987 | Nolan | 215/252 |
| 4,657,153 | 4/1987 | Hayes | 215/252 |
| 4,709,824 | 12/1987 | Thompson | 215/252 |

FOREIGN PATENT DOCUMENTS

| | | | |
|---|---|---|---|
| 2034674 | 6/1980 | United Kingdom | 215/252 |

*Primary Examiner*—Donald F. Norton

*Attorney, Agent, or Firm*—Charles E. Brown; Paul Shapiro; Charles A. Brown

[57] ABSTRACT

A plastic closure cap for containers wherein the closure cap is threadedly engaged on the container neck finish and has a tamper indicating band which is locked beneath a transfer bead on the container neck finish. The tamper indicating band is simply in the form of a plurality of segments which extend between circumferentially spaced bridges and which normally are curved radially inwardly. The tamper indicating band segments, however, will deflect radially outwardly and change shape so as to freely pass over the transfer bead as the closure cap is being applied to the container neck finish. After the tamper indicating band segments pass beyond the transfer bead, the segments snap back to their original positions due to tension and are locked beneath the transfer bead.

8 Claims, 1 Drawing Sheet

REVERSED-ARC BAND FOR TAMPER-EVIDENT CAP

This invention relates in general to new and useful improvements in plastic closure caps, and more particularly to closure caps having tamper indicating bands.

In general, most tamper indicating caps use bands which lock under a container finish transfer bead and are torn free of the cap during the removal of the cap. To lock the band in position, beads, lugs, or flaps are molded to the inside surface of the band. Such caps with tamper indicating bands are typically disclosed in prior U.S. Pat. Nos. 4,407,422; 4,457,438; 4,479,586; 4,488,655; 4,511,053; 4,530,437; 4,549,667; 4,643,321; 4,653,657; and 4,664,279.

In accordance with this invention, in lieu of the usual tamper indicating band, the tamper indicating band is formed in a plurality of tamper indicating segments which extend between bridges which connect the tamper indicating band to the skirt of the plastic closure cap. The tamper indicating band segments are arcuate in outline and project radially inwardly from the outline of the skirt of the closure cap. However, when the cap is being applied, the tamper indicating segments will be cammed radially outwardly so as to follow generally the outline of the skirt. After each tamper indicating band segment passes beyond the transfer bead of the container finish, the spring tension in each of the segments causes the segment to snap radially inwardly and catch under the transfer bead of the container finish.

With the above and other objects in view that will hereinafter appear, the nature of the invention will be more clearly understood by reference to the following detailed description, the appended claims, and the several views illustrated in the accompanying drawing.

Figure 3:
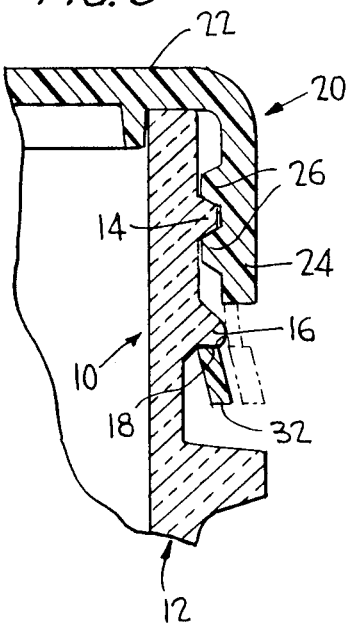
FIG. 3 is a fragmentary vertical sectional view taken generally along the line 3—3 of FIG. 1 showing the closure cap applied to a container neck finish with an intermediate part of one of the tamper indicating band segments being locked under the transfer bead of the container finish.

Referring now to the drawing in detail, reference is first made to FIG. 3 wherein there is illustrated the neck finish 10 of a conventional type of container 12, normally in the form of a bottle. The container neck finish 10 is provided with external threads 14 through which a plastic closure cap may be secured in place. Below the threads 14, the container neck finish includes a transfer bead 16 which has a downwardly facing shoulder 18 beneath which a tamper indicating band normally locks.

In accordance with this invention, there is provided a plastic closure cap, generally identified by the numeral 20. Basically speaking, the closure cap 20 includes an end panel 22 and an integral depending skirt 24. The skirt 24, as is best shown in FIG. 3, is provided with internal threads 26 which cooperate with the neck finish threads 14 so as to releasably lock the closure cap in place on the container neck finish 10.

This invention in particularly relates to the provision of a tamper indicating band which locks beneath the transfer bead 16 in engagement with the shoulder 18. This band is generally identified by the numeral 28 and is integrally connected to the lower edge of the skirt 24 by a plurality of bridges 30.

Figure 2:
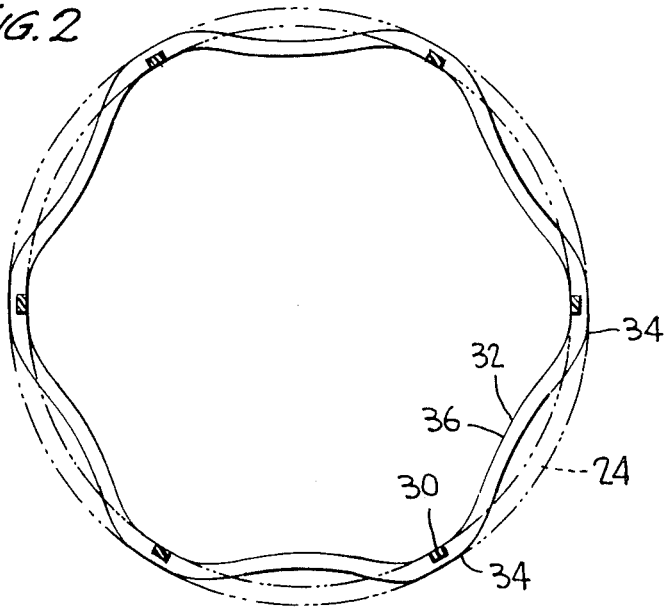
FIG. 2 is a horizontal sectional view taken generally along the line 2—2 of FIG. 1 and shows the outline of the tamper indicating band with each of the segments thereof being arcuate and radially inwardly offset.

In lieu of the conventional tamper indicating band, the band 28 is in the form of a plurality of tamper indicating band segments 32 with each segment 32 extending generally between a pair of the bridges 30. As is clearly shown in FIG. 2, each tamper indicating band segment 32 is arcuate in outline and while it does have terminal portions 34 which are generally axially aligned with the skirt 24, has a central portion 36 which is normally radially inwardly offset with respect to the outline of the skirt 24.

Figure 1:
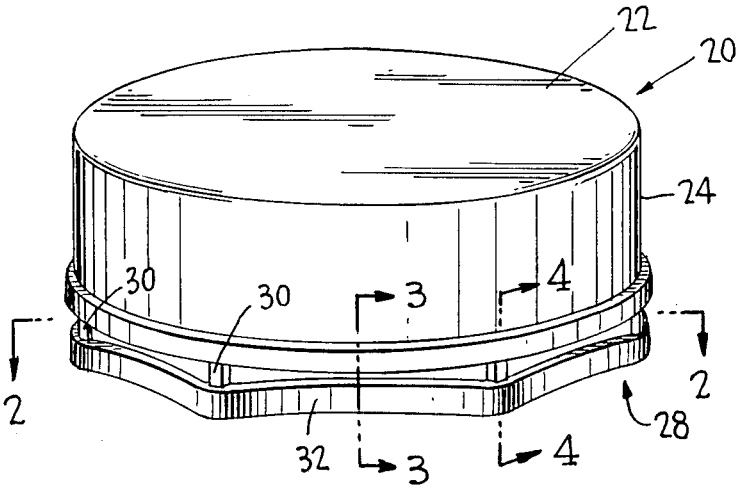
FIG. 1 is a top perspective view of a plastic closure cap formed in accordance with this invention.
Figure 4:
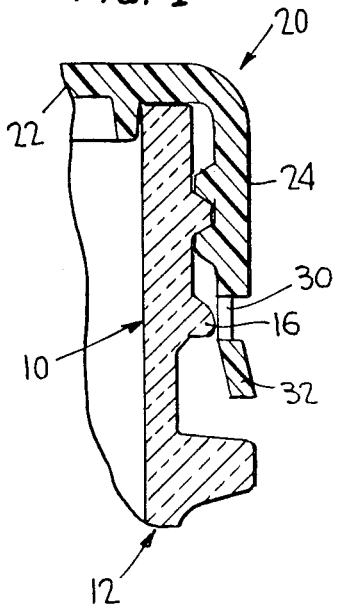
FIG. 4 is a fragmentary vertical sectional view similar to FIG. 3 showing the closure cap applied to a container neck finish with the view being in the area of one of the bridges.

Also as is best shown in FIGS. 3 and 4, each tamper indicating band segment 32 is tapered or flared radially outwardly and downwardly. This facilitates the deformation of each of the segments 32 radially outwardly so as to be generally axially aligned with the skirt 24 for passage over the transfer bead 16. After each of the tamper indicating band segments 32 has moved downwardly beyond the transfer bead 16, the tension in the segment will cause the segment by its natural spring action to snap beneath the transfer bead 16 and to lock the same in place in the manner shown in FIG. 3.

In accordance with the preferred embodiment of the invention, the bridges 30 are of a reduced thickness so as to be rupturable. Thus, when the closure cap 20 is removed by unscrewing the same and the skirt 24 moves upwardly while the tamper indicating band 28 is restrained by the transfer bead 16, the bridges 30 will rupture under tension and the tamper indicating band 28 will be retained on the container neck finish indicating tampering.

Figure 5:
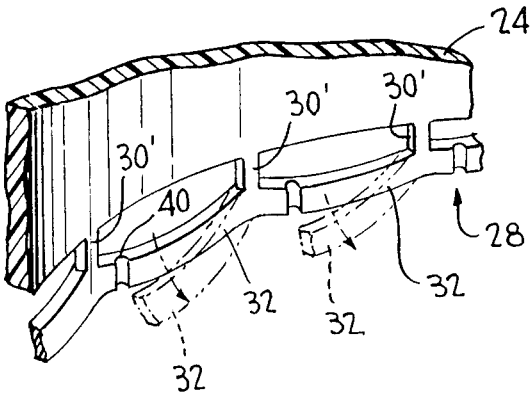
FIG. 5 is an enlarged fragmentary interior view of the bottom portion of the closure cap showing a modified form of tamper indicating band wherein the band is permanently attached to the skirt by way of the bridges and individual tamper indicating band segments are provided with weakened areas so as to affect the rupture thereof.

In a modified form of the invention, bridges 30' are provided with these bridges being of the same thickness as the tamper indicating band 28 and thus, not rupturable. Instead, each of the tamper indicating band segments 32 is provided with a vertical line of weakening 40 along which each of the segments 32 ruptures when the closure cap is removed, the segment deflecting downwardly to disengage from the transfer bead 16 as is shown in dotted lines in FIG. 5.

In the formation of the closure cap in accordance with this invention, a conventional side-action is used in mold construction in the tamper indicating band area. As far as the mold core is concerned, the undercut required by the radially inwardly curved configuration of the band segments ranges from zero at each bridge 30 to a maximum at the midpoint of each of the band segments. To help lead each segment to flex outward during core removal and so avoid damage to the upper inside edge of the tamper indicating band, the core immediately above the upper inside corner of plastic will be radiused or rounded before inclining outwardly. In this way, the tamper indicating band slides briefly against a vertical surface of the mold core. Before being gradually redirected outwardly, side-action being already off of the tamper indicating band exterior, the tamper indicating band is free to flex out to clear the core before snapping back into the as-molded position.

A principal feature of the invention is simplicity. Flaps tend to complicate the mold or require repositioning with additional equipment. Lugs and beads require the band to stretch during core withdrawal, which tends to limit the allowable lug or bead reach and often damages its profile. In accordance with this invention, the tamper indicating band simply flexes without the need to stretch. Plenty of band interference under the container neck finish transfer bead is available without risking additional profile damage during mold ejection, or having to mold separate parts needing assembly.

Al though only two preferred embodiments of the plastic closure cap with tamper indicating band formed in accordance with this invention have been specifically illustrated and described herein, it is to be understood that minor variations may be made in the cap and band arrangement without departing from the spirit and scope of the invention as defined by the appended claims.

I claim:

1. A plastic cap having a skirt carrying a tamper indicating band by way of a plurality of circumferentially spaced axially extending bridges, said plastic cap being improved by said tamper indicating band being non-circular in plan and in the form of a plurality of segments, each of said segments extending between an adjacent pair of said bridges, and each of said tamper indicating band segments in plan being primarily concavely bowed radially inwardly of respective bridges and an adjacent portion of said skirt for locking engagement beneath a transfer bead on a container finish.

2. A plastic cap according to claim 1 wherein said tamper indicating band segments are arcuate in plan.

3. A plastic cap according to claim 1 wherein said tamper indicating band segments are arcuate in plan and radially outwardly flexible.

4. A plastic cap according to claim 1 wherein said tamper indicating band segments are reversely curved in plan.

5. A plastic cap according to claim 2 wherein the total length of said tamper indicating band segments corresponds substantially to the circumference of said skirt.

6. A plastic cap according to claim 1 wherein said tamper indicating segments are of constant thickness and tapered outwardly and downwardly.

7. A plastic cap according to claim 1 wherein said bridges are of a reduced thickness as compared to said skirt and said tamper indicating band and form rupturable means for separating said tamper indicating band from said skirt.

8. A plastic cap according to claim 1 wherein at least certain of said tamper indicating band segments have rupturable weakening areas.

* * * * *